US007771041B2

(12) United States Patent
Koehn et al.

(10) Patent No.: US 7,771,041 B2
(45) Date of Patent: Aug. 10, 2010

(54) PRINTING SYSTEM

(75) Inventors: Chad A. Koehn, Surrey (CA); Jonathan H. J. J. Nikkel, Vancouver (CA)

(73) Assignee: Océ-Technologies B.V., Venlo (NL)

( * ) Notice: Subject to any disclaimer, the term of this patent is extended or adjusted under 35 U.S.C. 154(b) by 585 days.

(21) Appl. No.: 11/513,248

(22) Filed: Aug. 31, 2006

(65) Prior Publication Data

US 2008/0055382 A1 Mar. 6, 2008

(51) Int. Cl.
*B41J 29/38* (2006.01)
*B41J 2/01* (2006.01)
*B41F 1/28* (2006.01)

(52) U.S. Cl. ..... 347/104; 347/16; 101/474

(58) Field of Classification Search ..... 101/474; 248/362; 347/104; 400/648
See application file for complete search history.

(56) References Cited

U.S. PATENT DOCUMENTS 6,004,087 A * 12/1999 Muller ..... 411/180
6,328,491 B1 * 12/2001 Beehler et al. ..... 400/648
6,454,478 B2 * 9/2002 Wotton et al. ..... 400/656
2004/0245700 A1 12/2004 Asada et al.

FOREIGN PATENT DOCUMENTS

EP 1 304 225 A2 4/2003
EP 1 491 346 A2 12/2004
JP 9-220837 A 8/1997

* cited by examiner

*Primary Examiner*—Matthew Luu
*Assistant Examiner*—Kendrick X Liu
(74) *Attorney, Agent, or Firm*—Birch, Stewart, Kolasch & Birch, LLP

(57) ABSTRACT

A medium support member has a first surface for supporting a print medium and a second surface opposite to said first surface. The medium support member includes a plurality of recesses formed in the first surface and a plurality of protrusions formed in the second surface such that each recess has an associated protrusion opposite thereto. Each recess has an air passage connecting the recess with an interprotrusional space formed between the protrusions. A printing system includes a device for image-wise application of marking material to a print medium, base member and the medium support member. A method of forming the medium support member includes supporting a sheet of base material, pressing a first punch to form the recess and the protrusion in the sheet of base material, and pressing a second punch such that a perforation is applied into the sheet of base material.

17 Claims, 4 Drawing Sheets

PRINTING SYSTEM

BACKGROUND OF THE INVENTION

1. Field of the Invention

The present invention relates to a medium support member and a printing system including the medium support member. The present invention also relates to a method of forming a medium support member.

2. Description of Background Art

Medium supports for stationary holding and flattening of print media during a print process are commonly used. In the field of printing, it is known to use a suction box for holding and flattening print media during a printing operation. Such a suction box usually has a perforated top surface and the inner volume of the suction box is maintained at an underpressure by means of a vacuum pump.

It is a disadvantage of this kind of medium supports, that the construction of the suction boxes, on which the print media are supported, have a very complex construction to distribute the underpressure from the suction device to the print medium. The sizes of suction boxes vary per printing system. In particular, suction boxes or suction tables for industrial flatbed printing systems can get very spacious. Although the suction table of a printing system has one size, the print media that are processed on the system can have multiple sizes. Not all sizes of print media cover the complete suction table during the printing process. To overcome the problem of suction leakage via perforations that are not covered by a print medium, the table, in which the underpressure is distributed over the plurality of perforations, must contain sufficient air flow resistance to uphold the underpressure when not all perforations are covered by a print medium. As the distance between a marking material applying printhead and the print medium must be very well defined, and preferably constant over the whole print area, the support surface of the support table must be very well defined. All these specifications contribute to the technical complexity of the support table.

SUMMARY OF THE INVENTION

It is an object of the present invention to provide a medium support for flattening and at least temporarily keeping the print medium stationary with reduced complexity. To this end, an embodiment of the present invention is directed to a medium support member having a first surface for supporting a print medium and a second surface opposite to the first surface, said medium support member comprising a plurality of recesses formed in the first surface and a plurality of protrusions formed in the second surface such that each of said plurality of recesses has an associated protrusion opposite thereto, said plurality of protrusions forming an interprotrusional space therebetween, wherein each of said plurality of recesses has an air passage connecting with the interprotrusional space.

A medium support member according to an embodiment of the present invention enables the use of a very simple support construction, while the accuracy of the system does not degrade. In fact, the medium support member according to the present invention can be implemented as a sheet, in which the recesses, protrusions and air passages are punched. This sheet can be placed on a simple base member such as a support table with a straightforward connection to a suction device. This combination gains a very simple, accurate support member, which is able to fix the position of a print medium on the support member.

A medium support member according to the present invention distributes the underpressure that is applied to the interprotrusional space over the plurality of recesses via the air passages that are formed between the interprotrusional space and the recesses. In an embodiment of the present invention, the protrusions, which are associated with the recesses, form a plurality of bearing points to support the medium support member on a table and introduce an air flow restriction inside the interprotrusional space. With this construction, suction leakage via recesses that are not covered by a print medium does not diminish the print medium position fixation significantly during the printing process.

The amount of underpressure that is applied to the recesses can be adapted to the weight, coating, porosity and other properties of the actual print medium. The volume of the interprotrusional space, in which the underpressure is applied, is relatively small in comparison with known table volumes that are underpressurized. This contributes to the controllability of the underpressure as the control lag is decreased.

It has been found that the application of a recess in combination with an air passage, according to the present invention, increases the amount of holddown force and may decrease the occurrence of noise in comparison with a small perforation only. The dimensions of the recess and the perforation are chosen large enough such that the holddown force is sufficiently high to hold down the medium and small enough to minimize the suck-in risk. If the recess is chosen too large for floppy media, a large underpressure will suck the media into the recess. This may damage the medium. The area of the recess is chosen such that the heat exchange profile does not differ significantly underneath an unsupported area of the medium at a recess. A significant change of the heat exchange profile may influence image quality, due to color banding, drying time changes and other unwanted effects. The amount of underpressure and recess and perforation dimensions are chosen such that the air flow through a supported medium is not too large. In particular, in the case of a porous media, an air flow through the porous media can influence the image quality during the printing process.

The shape of the recess may be circular, square, rounded or any shape that suffices the demands of holding down and supporting a print media. In a preferred embodiment of the present invention, the shape of the recess and air passage is mainly circular in a view perpendicular to the support surface and the center point of the air passage is positioned on the circumference of the recess. The shape and dimensions of the recesses and air passages may vary over the support area to optimize the local suction and hold down properties of the medium support member. The recess may be formed such that stiffening elements are formed inside the recess. The latter may be formed by a punch that does not punch down the entire recess area, but punches a recess comprising stiffening wall-elements inside the recess. In particular, in applications in which larger recesses are used or a higher underpressure is applied this may be advantageous.

In an embodiment of the medium support member according to the present invention, the air passage is a perforation formed near an edge of the recess. This construction enables the protrusion to act as a support for the medium support member on a table, while the production of such a perforation is simple and cost efficient. The perforation can be punched in the base material simultaneously with the associated recess and protrusion. In that case, there is no need for an additional alignment step for the perforator.

In another embodiment of the medium support member according to the present invention, the protrusions have approximately the same height with respect to said second surface. By forming the protrusions such that they all have the same height with respect to the second surface, the support surface of the medium support member will be located at a constant distance with respect to the printhead over the print area. This has a direct positive effect on the print quality. The height of the protrusions and, the associated depth of the recesses are chosen such that the interprotrusional space is large enough to distribute the underpressure in operation over the recesses. In addition, the total construction, in particular the remaining material between the protrusions and the base material, has enough stiffness to withstand the weight of the medium support member including a print medium and to withstand the holddown force, which is imposed by the underpressure.

In another embodiment of the medium support member according to the present invention, the plurality of recesses form a uniform pattern over the first surface. A uniform pattern will distribute the underpressure from the recesses to the print medium in uniform fashion. A uniform pattern of recesses over the support area contributes to a uniform flattening of the print media, which is advantageous for the print quality. In another embodiment of the medium support member according to the present invention, the inter-recess distance of the plurality of recesses varies over the area of the support surface. The density of the recesses may increase near the edges, such that an additional holddown force is applied to a print medium near the edges of the support surface. Alternatively the density of the recesses may decrease towards the edges, such that the air leakage near the edges is decreased, in case of a small print media, which does not cover the complete support surface.

In another embodiment of the medium support member according to the present invention, the table is divided into multiple sections to match with different media sizes. By applying the underpressure mainly or wholly to the section or sections that are covered by the print media, the total leakage of underpressure can be limited. The division into multiple sections may be implemented by dividing members that are applied in the interprotrusional space. These members are placed in the interprotrusional space and define a subsection thereof. The dividing of the interprotrusional space into multiple subspaces increases the controllability of the underpressure as all subspaces may have a separate underpressure device. The underpressure device may apply a high airflow in combination with a low underpressure, or alternatively a low airflow in combination with a high underpressure. The latter situation increases the advantageousness of a division into multiple subspaces.

In a second aspect, the present invention relates to a printing system, comprising a device for an image-wise application of marking material to a print medium, and a support structure for supporting said print medium, wherein said support structure comprises a base member and the medium support member according to the present invention.

A printing system according to the present invention enables a well-controlled hold down of a print medium during the printing process while the construction remains relatively simple and cost efficient. The relatively small volume between the base member and the medium support member contributes to the controllability of the underpressure, such that the amount of underpressure can be easily adapted with respect to the properties of the actual print medium.

In an embodiment of the printing system according to the present invention, it further comprises an underpressure device that applies an underpressure in the interprotrusional space formed between the base member, the second surface and the protrusions. By applying an underpressure to the interprotrusional space, the recesses of the support member are supplied with a force to hold down the print medium during the printing process. The underpressure device may include a structure that prevents suction leakage at the edges of the medium support member, such that the underpressure does not leak away through an opening between the medium support member and the base member.

In a further embodiment of the printing system according to the present invention, the underpressure device is a vacuum pump. By pumping air via the recesses and the air passages into the interprotrusional space and via the suction duct away by a vacuum pump, the air pressure under the print medium is lower than the air pressure in the surrounding environment of the print medium. Therefore the surrounding air presses the print medium onto the medium support member, fixing the position of the print medium.

In another embodiment of the printing system according to the present invention, the medium support member is supported on the base member by the plurality of protrusions. This construction enables a simple and low cost assembly of the printing system, while the accuracy is maintained.

In a third aspect, the present invention relates to a method of forming a recess, an air passage and protrusion in a medium support member, comprising the steps of supporting a sheet of base material, pressing a first punch, having a predetermined shape into the sheet of base material thereby forming a recess and an associated protrusion in the sheet of base material and pressing a second punch, which punch having a predetermined shape of the air passages into the sheet of base material such that a perforation is applied into the sheet of base material.

Using this relatively well-understood production process to form the medium support member, an accurate and cost efficient medium support member is produced. The production process is very reproducible in particular in comparison with e.g. drilling. It is very efficient, since the recesses and protrusions are formed at the same time.

In an embodiment of the method according to the present invention the sheet of base material is first perforated to form the air passages by means of the second punch before the first punch forms the recess and associated protrusion in the sheet of base material. This order is advantageous for the punching process speed, since the internal stresses that arise while punching the recess are well assimilated. It will be understood that forming the recess before perforating may also gain the desired effect.

In a further embodiment of the method according to the present invention, the steps of pressing a first punch, having a predetermined shape into the sheet of base material thereby forming a recess and an associated protrusion in the sheet of base material and pressing a second punch, which punch having the desired shape of the air passages into the sheet of base material such that a perforation is applied into the sheet of base material are applied simultaneously by means of a single punch.

This gains a significant saving of time during the execution of the method.

In a further embodiment of the method according to the present invention, a plurality of recesses, a plurality of air passages and a plurality of protrusions are punched simultaneously. Therefore no additional alignment step is necessary in between the recess punching step and the perforating step. This gains an additional significant saving of time during the execution of the method while producing a medium support member according to the invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
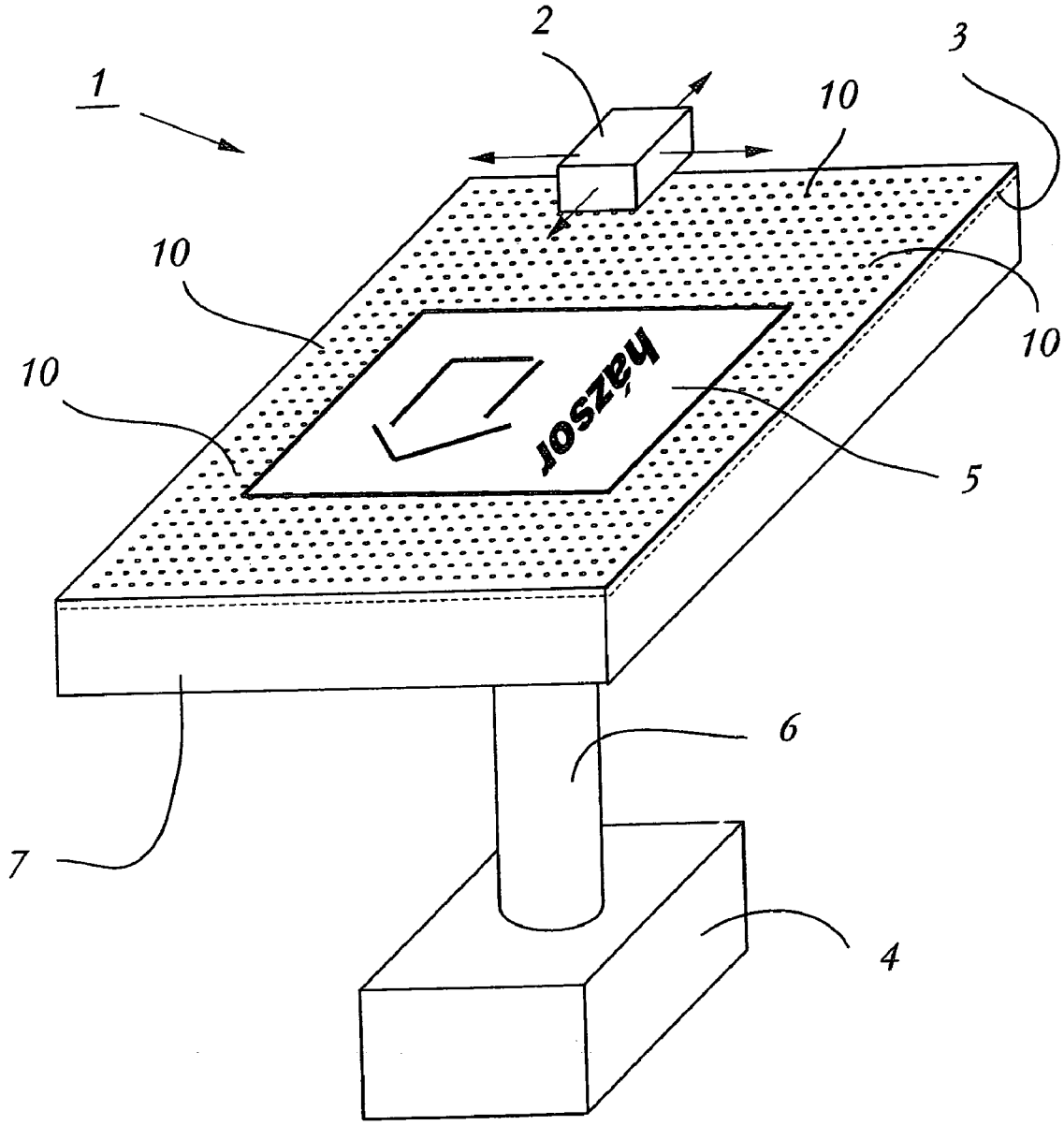
FIG. 1 is a schematic view showing a printing system comprising a medium support member according to an embodiment of the present invention.

FIG. 1 shows a schematic view of a printing system comprising a medium support member according to an embodiment of the present invention. The printing system 1 has a table 7, which functions as a base member. A medium support member 3 is positioned on top of the table 7. The medium support member 3 comprises a plurality of suction recesses 10. Each of the plurality of suction recesses 10 has an air passage to a space that is formed between the medium support member 3 and the table 7. The space is maintained at an underpressure in operation. The underpressure is applied by means of a vacuum pump 4, which acts as a suction device. The vacuum pump 4 is operatively associated with the space between the medium support member 3 and the table 7 by means of a suction duct 6. The duct 6 extends from the vacuum pump 4 through the table 7 to the space. Both ends of the duct 6 comprise closures such that the underpressure in the space is maintained in operation.

The underpressure in the suction recesses 10 keeps a print medium 5, which is positioned on top of the medium support member 3, stationary and flat. A carriage (not illustrated) comprising one or more printheads 2 is positioned above the medium support member 3. For the sake of simplicity only one printhead 2 is illustrated, but it will be clear that multiple printheads are alternatively applicable. The carriage is moveable across the medium support member 3. In operation, the carriage, comprising the printhead 2 is controlled to move across the print medium 5, while jetting droplets of marking material in an image-wise fashion. In this embodiment, the printhead 2 ejects droplets of UV-curable ink, but it will be clear for the skilled person, that other types of marking material, such as solvent inks, watery inks or hotmelt inks are alternatively applicable. In this embodiment, the print medium 5 is kept stationary and flat during the entire print operation, while the printhead 2 moves alternately in a main and a sub-scanning direction. In an alternative embodiment, the print medium is kept stationary and flat during a printhead movement in a sub-scanning direction (a swath), and is transported in a main scanning direction in between swaths.

Figure 2A:
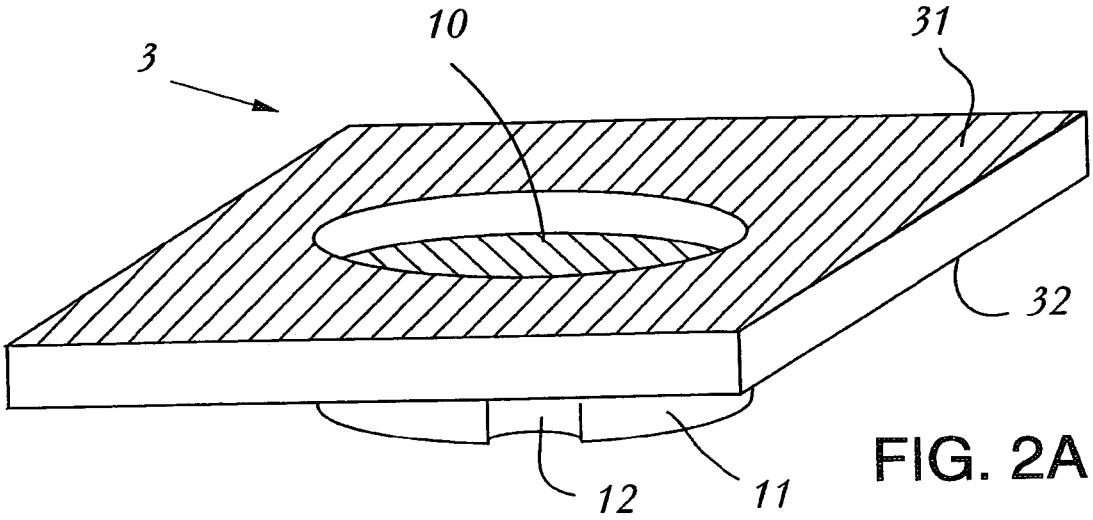
FIG. 2A is a schematic perspective view of a detail of a medium support member according to an embodiment of the present invention.
Figure 2B:
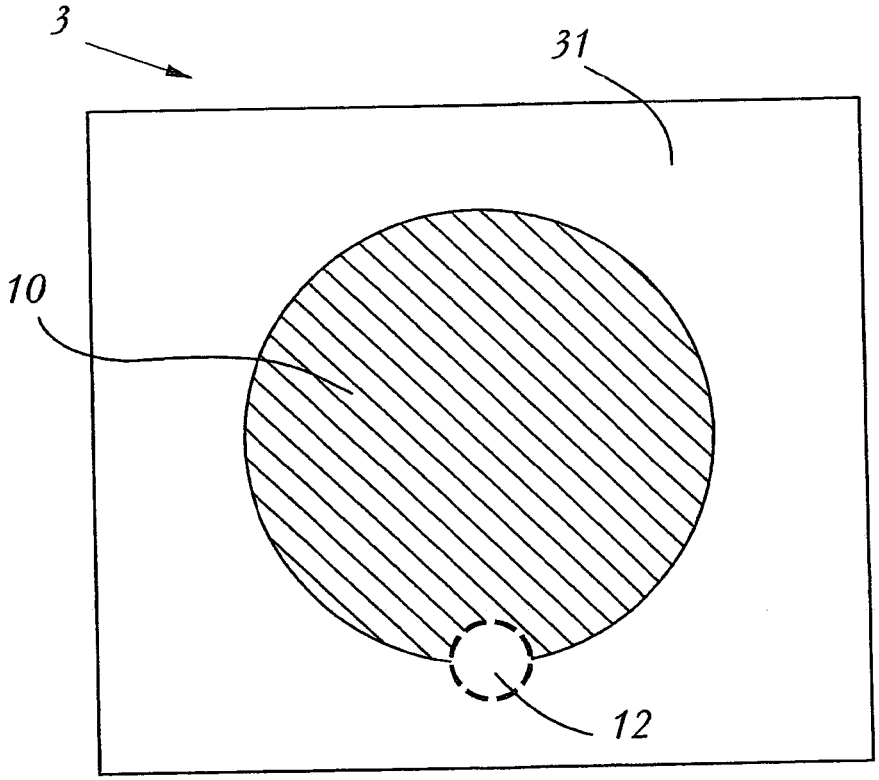
FIG. 2B is a schematic top view of the detail of FIG. 2A.

FIGS. 2A and 2B show a schematic view of a detail of a medium support member according to an embodiment of the present invention in respectively perspective and top view. The medium support member comprises multiple suction recesses, of which one is shown in FIGS. 2A and 2B. The medium support member 3 can measure 3 by 4 meters and can be 150 μm thick. The medium support member 3 comprises approximately 450 recesses per square meter. The recesses have a diameter of approximately 0.5 mm. The recess 10 acts as a pressure chamber when an underpressure is applied. The pressure chamber keeps the position of a print medium 5 stationary during a printing process. When a print medium 5 is positioned on top of a suction recess 10 while applying underpressure, the print medium 5 is sucked onto the top surface 31 of the medium support member 3, thereby flattening and fixing the position of the print medium 5. The underpressure inside the suction recess 10 is controlled to be high enough to fix and flatten the print medium and low enough not to damage the print medium 5 by deforming it.

FIGS. 2A and 2B show the construction of a suction recess of the medium support member 3. Each recess 10 has an associated protrusion 11 opposite to the recess 10. The protrusion 11 has been formed by punching the recess 10 in the base material of the medium support member 3. In this embodiment, the recess 10 has been punched into the first surface 31 of the base material to a depth of half the thickness of the base material. The remaining material therefore, has enough stiffness to bear the weight of the medium support member 3 including the print medium 5. To enable the application of the underpressure inside the recess, a perforation 12 acting as an air passage has been punched near the edge of the recess 10.

Figure 3A:
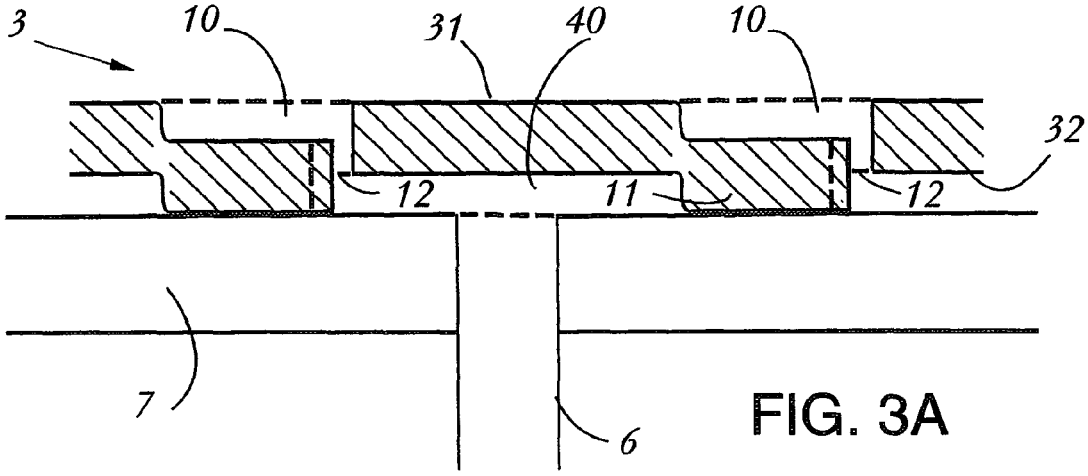
FIG. 3A is a schematic cross sectional view of a medium support member according to an embodiment of the present invention.
Figure 3B:
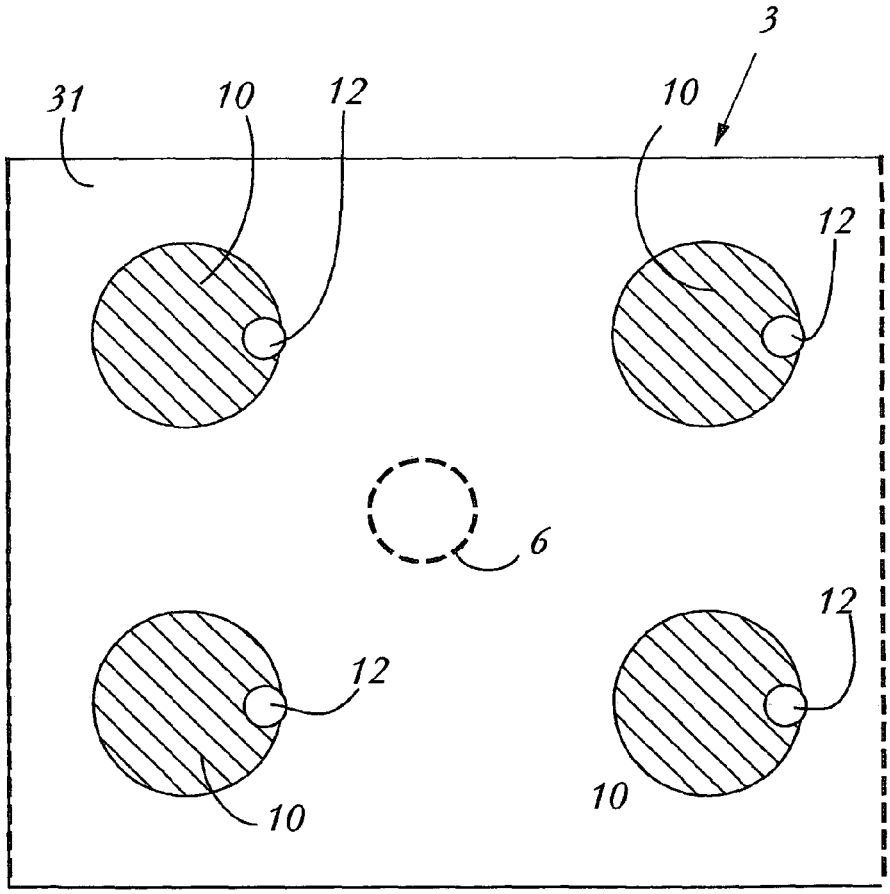
FIG. 3B is a schematic top view of a medium support member according to an embodiment of the present invention.

FIGS. 3A and 3B show respectively a schematic cross sectional view and a top view of a medium support member according to an embodiment of the present invention. As illustrated in FIG. 3A the medium support member 3 is supported on the table 7 by means of the protrusions 11 that are associated with the recesses 10. The side edges of the table enclose the medium support member 3 such that the underpressure is directed via the interprotrusional space 40 through the air passages 12 into the recesses 10 and not, or at least in a significant lower amount through the side edges of the table 7.

The suction device 4 develops an underpressure. The underpressure is applied to the interprotrusional space 40, i.e. the space that is defined between the table, the second surface 32 of the medium support member and the plurality of protrusions 11. The connection between the suction device 4 and the interprotrusional space 40 is implemented via a suction duct that extends through the table. In a practical implementation, the dimensions of the duct can be of such a size that multiple protrusions fit within the circumference of the duct. The dimensions of the duct are dependent on the amount of underpressure that is necessary to fulfil the demands of holding down and flattening print media. It will be clear for the person skilled in the art that the connection between the suction device 4 and the interprotrusional space 40 can have any implementation that applies the underpressure from the suction device 4 to the interprotrusional space 40.

To fix the position of a print medium 5 on the medium support member 3 the underpressure of the interprotrusional space 40 is distributed over the plurality of recesses 10 via air passages 12. In this embodiment a perforation 12 has been applied near the edge of the recesses 10, but it will be clear for the skilled person that any implementation of an air passage between the recess 10 and the interprotrusional space 40 will suffice.

In an alternative embodiment, the system comprises multiple suction devices 4. These suction devices 4 are connected to the interprotrusional space 40. Alternatively the interprotrusional space 40 is divided into multiple suction areas by means of one or more gas tight closures in between the second surface 32 of the medium support member 3 and the table 7. The suction areas are connected to suction ducts. The ducts are connected to one vacuum pump using pressure valves, or alternatively to one pump per duct.

Figure 4:
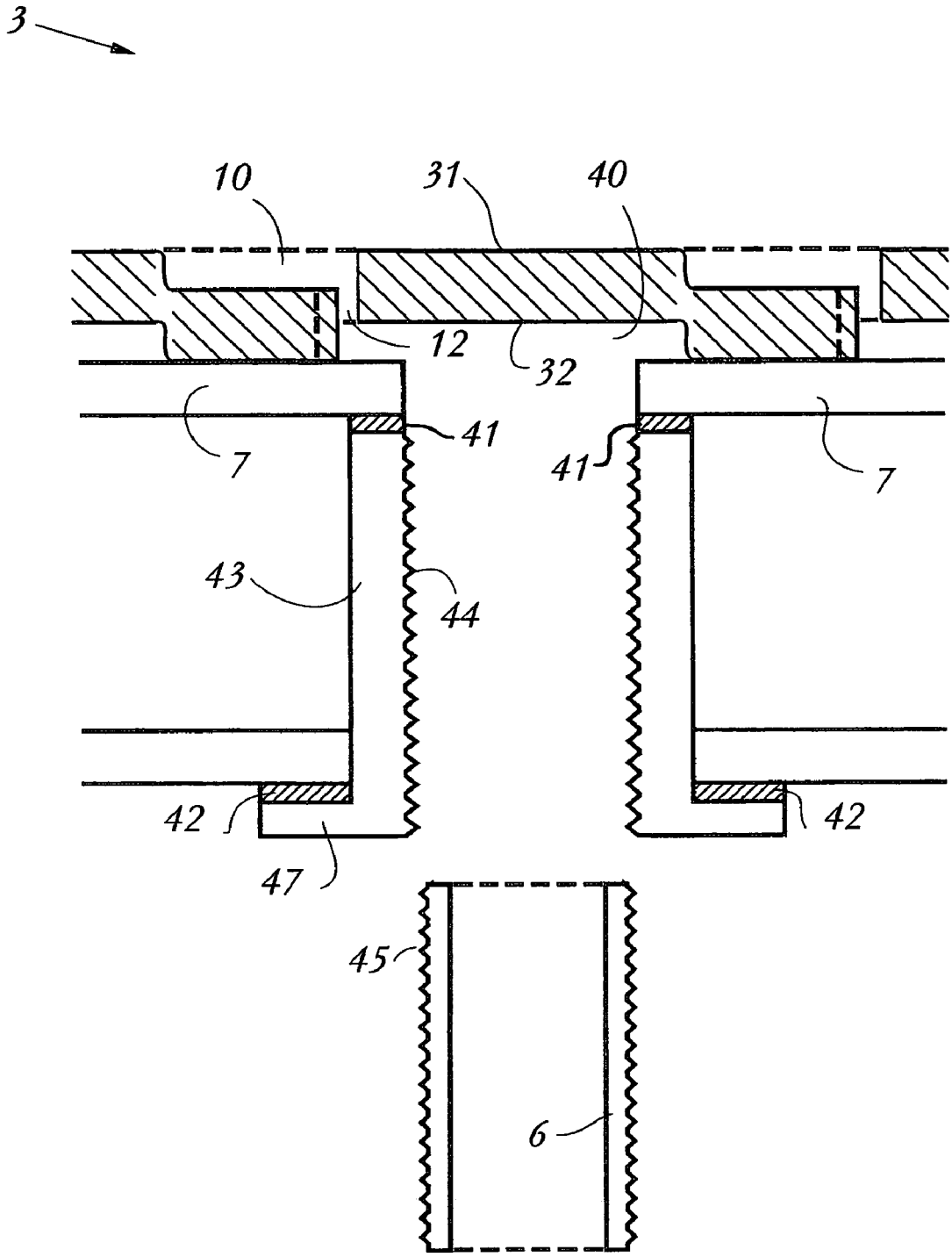
FIG. 4 is a schematic cross sectional view of a medium support member according to an embodiment of the present invention.

FIG. 4 is a schematic cross sectional view of a medium support member according to an embodiment of the present invention. FIG. 4 shows more detail of the attachment of the suction device, through the table to the interprotrusional space. The medium support member 3 is positioned on the table 7. The plurality of recesses 10 are connected with the interprotrusional space 40, defined by the protrusions 11, the table 7 and the second surface 32, via the air passages 12. An underpressure is applied to the interprotrusional space 40 by means of a suction device 4, which is connected to the interprotrusional space 40 by means of a suction duct 6. The suction duct 6 is connected to the suction device 4 on a first side and a second side is fed through a bore in the table 7. The table 7 is of the known box type. A box is stiffened by means of a honeycomb structure. Both the top and bottom surface of the table are bored such that the top bore is smaller than the bottom bore. A mainly cylindrical element 43, having a diameter that is smaller than the bottom bore diameter and larger than the top bore diameter is positioned inside the bore. The cylindrical element 43 having a screw thread 44 is fastened by means of a sealing adhesive 41 to the circumference of the top bore. The cylindrical element 43 comprises a flange 47 that is provided with a sealing adhesive 42 to fix the cylindrical element 43 into the bore of table 7. The suction duct 6 is provided with an associated screw thread 45 such that this suction duct 6 is releasably attachable into the cylindrical element 43 of the table 7. This provides a mainly air tight connection between the suction device 4 and the interprotrusional space 40.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A medium support member in the form of a sheet of material and having a first surface for supporting a print medium and a second surface opposite to the first surface, said medium support member comprising:

a plurality of indented recesses formed in the first surface; and a plurality of protrusions formed in the second surface such that each of said plurality of recesses has an associated protrusion opposite thereto, said plurality of protrusions forming an interprotrusional space therebetween, wherein each of said plurality of indented recesses has an air passage connecting with the interprotrusional space.

2. The medium support member according to claim 1, wherein the air passage is a perforation formed near an edge of the recess.

3. The medium support member according to claim 1, wherein each of said plurality of protrusions has approximately the same height with respect to said second surface.

4. The medium support member according to claim 2, wherein each of said plurality of protrusions has approximately the same height with respect to said second surface.

5. The medium support member according to claim 1, wherein the plurality of recesses form a uniform pattern over the first surface.

6. The medium support member according to claim 1, wherein the distance between adjacent recesses vary over the area of the support surface.

7. The medium support member of claim 1, wherein the second surface of the medium support member is located on an opposite side of the first surface of the member.

8. A printing system, comprising:

a device for an image-wise application of marking material to a print medium; and a support structure for supporting said print medium, said support structure comprising:

a base member; and a medium support member in the form of a sheet of material and having a first surface for supporting a print medium and a second surface opposite to the first surface, said medium support member including a plurality of indented recesses formed in the first surface and a plurality of protrusions formed in the second surface such that each of said plurality of recesses has an associated protrusion opposite thereto, said plurality of protrusions forming an interprotrusional space therebetween, wherein each of said plurality of indented recesses has an air passage connecting with the interprotrusional space.

9. The printing system according to claim 8, further comprising an underpressure device, said underpressure device adapted to apply an underpressure in the interprotrusional space formed between the base member, the second surface and the protrusions.

10. The printing system according to claim 9, wherein the underpressure device is a vacuum pump.

11. The printing system according to claim 8, wherein the medium support member is supported on the base member by the plurality of protrusions.

12. A method of forming an indented recess, an air passage and a protrusion in a medium support member in the form of a sheet of material, said method comprising the steps of:

supporting the sheet of base material;

pressing a first punch having a predetermined shape into the sheet of base material to form the indented recess and the protrusion in the sheet of base material; and pressing a second punch having a predetermined shape of the air passage into the sheet of base material such that a perforation is applied into the sheet of base material.

13. The method according to claim 12, wherein said steps of pressing the first and second punches are applied simultaneously by means of a single punch.

14. The method according to claim 12, wherein a plurality of recesses, a plurality of air passages and a plurality of protrusions are punched simultaneously.

15. A medium support member in the form of a sheet of material and having a first surface for supporting a print medium and a second surface opposite to the first surface, said medium support member comprising:

a plurality of indented recesses defined by a portion of the medium support member which is indented in the first surface of the medium support member and which protrudes beyond the second surface of the medium support member, said plurality of protrusions forming an interprotrusional space therebetween, wherein each of said plurality of indented recesses has an air passage connecting with the interprotrusional space.

16. The medium support member of claim 15, further comprising an air passage extending through the indented portion of the medium support member at an edge of the recess.

17. The medium support member of claim 15, wherein the second surface of the medium support member is located on an opposite side of the first surface of the member.

* * * * *